US006604260B1

(12) United States Patent
Henninger

(10) Patent No.: US 6,604,260 B1
(45) Date of Patent: Aug. 12, 2003

(54) CARD CLOTHING FOR A TEXTILE MACHINE

(75) Inventor: Friedrich Henninger, Flachslanden (DE)

(73) Assignee: Staedtler & Uhl, Schwabach (DE)

( * ) Notice: Subject to any disclaimer, the term of this patent is extended or adjusted under 35 U.S.C. 154(b) by 0 days.

(21) Appl. No.: 10/148,128

(22) PCT Filed: Nov. 10, 2000

(86) PCT No.: PCT/EP00/11105

§ 371 (c)(1),
(2), (4) Date: May 28, 2002

(87) PCT Pub. No.: WO01/38617

PCT Pub. Date: May 31, 2001

(30) Foreign Application Priority Data

Nov. 26, 1999 (DE) ..... 199 56 911

(51) Int. Cl.[7] ..... D01G 15/84
(52) U.S. Cl. ..... 19/114
(58) Field of Search ..... 19/98, 102, 104, 19/105, 108, 110, 111, 112, 113, 114, 115 R, 150, 157, 218; 83/836, 835, 846, 847, 848, 851, 852, 853, 854, 855, 908; 40/97, 100

(56) References Cited

U.S. PATENT DOCUMENTS 2,222,799 A * 11/1940 Howe ..... 19/82
4,590,645 A * 5/1986 Graf ..... 19/114
4,653,152 A * 3/1987 Wada ..... 19/114
4,964,195 A * 10/1990 Hollingsworth ..... 19/114
5,067,203 A * 11/1991 Hollmann ..... 19/114
5,228,173 A * 7/1993 Egerer ..... 19/218

FOREIGN PATENT DOCUMENTS

| | | |
|---|---|---|
| EP | 0 557 698 A1 | 9/1993 |
| GB | 937405 | 9/1963 |
| GB | 974 186 A | 11/1964 |
| GB | 2 157 330 A | 10/1985 |

OTHER PUBLICATIONS

Patent Abstract of "JP 03206171" Entitled "Card Clothing Wire And Raised Card Clothing", published Sep. 9, 1991, applicant Kanai Hiroyuki.

* cited by examiner

*Primary Examiner*—Gary L. Welch
(74) *Attorney, Agent, or Firm*—Browdy and Neimark, P.L.L.C.

(57) ABSTRACT

In card clothing for a textile machine comprising a plurality of adjacent spaced-apart needles or serrated punched cut-outs disposed in rows, wherein the needles or serrated punched cut-outs are stamped and accordingly have a non-rectangular cross-sectional geometry, wherein a free passage zone for the fibers being combed is formed between the spaced-apart needles or serrated punched cut-outs, it is provided that the free passage zone (A) steadily widens viewed in the direction of travel of the sliver.

12 Claims, 2 Drawing Sheets

FIG. 1
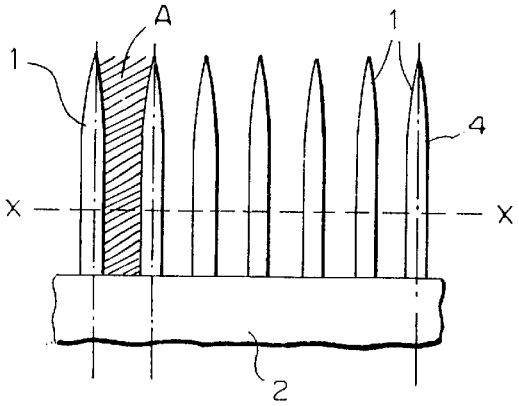
FIG. 2
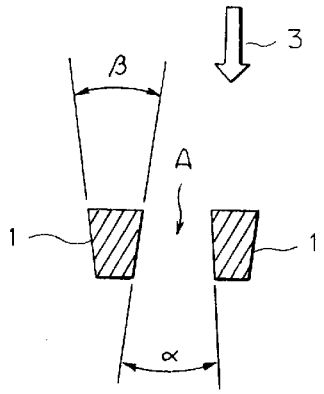
FIG. 3
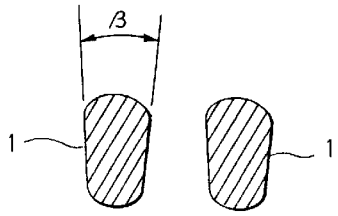
FIG. 4
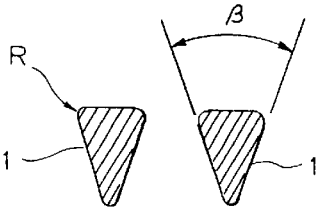
FIG. 5
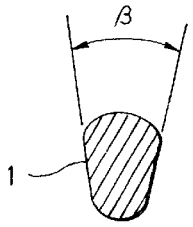
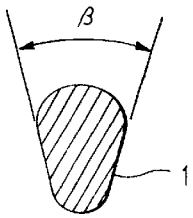
FIG. 6

CARD CLOTHING FOR A TEXTILE MACHINE

BACKGROUND OF THE INVENTION

1. Field of the Invention

The present invention is directed to card clothing for a textile machine comprising a plurality of adjacent spaced-apart needles or serrated punched cut-outs disposed in rows, wherein the needles or serrated punched cut-outs are stamped and accordingly have a non-rectangular cross-sectional geometry, wherein a free passage zone for the fibers being combed is formed between the spaced-apart needles or serrated punched cut-outs.

2. Summary of the Invention

Card clothing of this type is used for various types of textile machines, e.g., circular combs, fixed combs, carding, etc. In this context it is already known to at least partially shape the needles or the tips of serrated punched cut-outs by means of stamping, i.e., cold forming, in order to thus alter the original round or rectangular cross-sectional configuration.

In the case of needles, for example, it is already known to impart to them a rhombic cross-sectional configuration so that, viewed in the direction of the relative movement between the sliver and the needles, the free passage between adjacent needles initially narrows in order to then widen again starting from the narrowest point.

This design, however, has the shortcoming that impurities may collect and become wedged in the narrowing zone in such a way that they can no longer be removed even with cleaning actions, e.g., a cleaning with compressed air.

With this as the starting point, the invention has as its object to improve card clothing of the above type in such a way that the cleaning effect or combing effect, respectively, are improved.

This object is met according to the invention in such a way that the free passage zone steadily widens viewed in the direction of travel of the sliver. This means, in other words, that the narrowest point of the passage zone is located, viewed more or less in the direction of the relative movement, at the outermost start of the passage so that a jamming and collecting of particles is prevented since particles that are to be combed out are either small enough so that they can pass through the passage or, if they have an even slightly larger diameter, they can fall off without jamming, or they are removed, at the latest, during the cleaning process.

In a further improvement of the invention, provision is made for the free passage zone to have a trapezoidal basic shape and for the needles or tips of the serrated punched cut-outs to be stamped such that they have a triangular or trapezoidal basic shape in cross section.

The triangle corners or trapezoid corners are advantageously rounded.

With the inventive design it is made possible that impurities such as boll fragments and grains of sand, which can collect in conventional card clothing, are only briefly retained due to the widening cross section in such a way that they make only point contact or linear contact at the beginning of the passage.

The result that is achieved in this manner is that the card clothing remains clean and consistent operating results are attained and the fibers can more easily be pulled through the barrier, i.e., an overall improved combing result. The long fiber content in the combing waste decreases and the machine can be optimally adjusted so that an improvement of the economic aspect is achieved. This also includes a longer life due to lesser wear on the card clothing. Lastly, boll fragments, burls and noils that are not pulled out are held back and a jamming of the boll fragments is prevented so that an altogether better combing result is attained.

Provision may furthermore advantageously be made for the needles or tips to be formed in cross section such that they have side surfaces that are convexly curved outward, a rounded front face viewed in the direction of the movement relative to the sliver, and a rear end face that tapers to a relatively sharp point.

In other words, the needles may, in cross section, have the profile of a symmetrical or asymmetrical aircraft wing.

This results in a flow along the needles similar to that of the aircraft wing, so that the fibers of the sliver are subjected to pressure fluctuations whereby impurities are loosened that would otherwise collect. Burls, dust and light-weight pieces are held back by the negative pressure.

The invention will be explained in more detail below, based on a preferred embodiment in conjunction with the drawing.

BRIEF DESCRIPTION OF THE DRAWINGS

FIG. 1 shows a partial side-view of a row of needles of card clothing for a machine, FIGS. 2 through 6 show various cross-sectional configurations of needles and configurations of the resulting free passage between two needles.

DESCRIPTION OF THE PREFERRED EMBODIMENT

Figure 7:
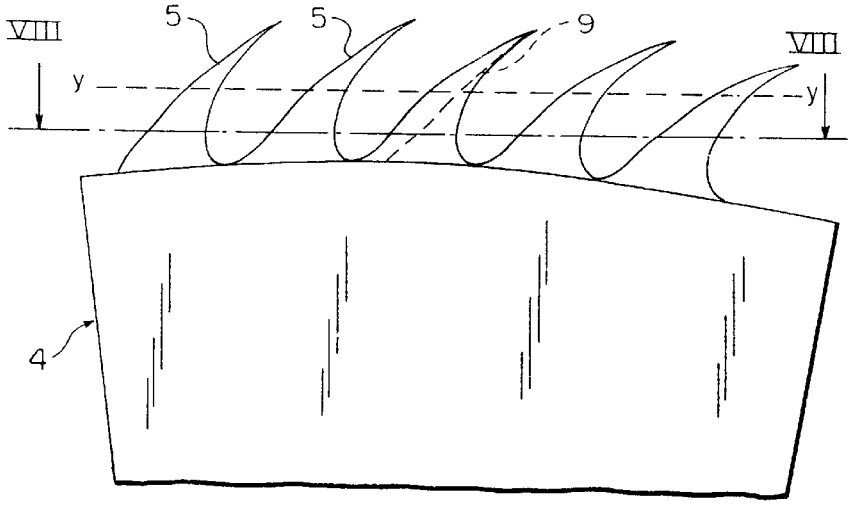
FIG. 7 shows a side view of a serrated punched cut-out in card clothing.

In FIG. 1 a row of needles 1 is presented that are held between two cover plates 2 under formation of a pin strip.

The needles 1 are disposed between the two cover plates 2 parallel and at a distance from one another in such a way that a free passage zone A remains between two given needles 1 through which the fibers being combed is moved in the direction of the arrow 3 drawn above FIGS. 2 through 6.

In the embodiment according to FIG. 2, the needles 1 have an exactly trapezoidal cross section in such a way that the free passage zone A steadily widens at an angle a between the needles 1 in the direction of travel (arrow 3) of the fibers along a plane x-x perpendicular to the longitudinal axis 4 of the needles 1.

In the embodiment according to FIG. 3, the needles also have a trapezoidal basic shape, however, they are rounded at their face ends and accordingly taper in the direction of travel (arrow 3) by an angle β.

According to the embodiment of FIG. 4, the cross section of the needles 1 is essentially triangular with a taper angle β of the needle that is considerably larger than in the embodiment of FIG. 3, with the corners rounded with a radius R.

FIGS. 5 and 6, lastly, show embodiments with an approximately dropshaped configuration wherein the leading face end viewed in the direction of travel (arrow 3) is designed well rounded and the opposite face end also has a pronounced rounding. In the embodiment according to FIG. 6 the taper angle β is greater than in the embodiment according to FIG. 5.

Figure 8:
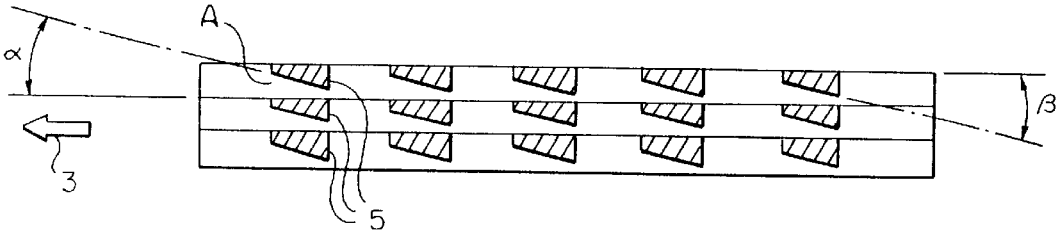
FIG. 8 shows a section along the line VIII—VIII in FIG. 7, and FIGS. 9 and 10 show sections through a fixed comb covered with needles wherein the needles are formed in cross section like a symmetrical or asymmetrical aircraft wing profile.

FIG. 7 shows a serrated punched cut-out 4, with a plurality of such serrated punched cut-outs 4 being disposed side by side in card clothing, e.g., on the round comb of a machine, in such a way that the tips 5 of adjacent serrated punched cut-outs 4 are spaced apart from one another and, accordingly, a free passage A results for the fibers being combed in such a way that a relative movement is created between the fibers and the tips 5 so that a direction of travel results according to the arrow 3 in FIG. 8.

The tips 5 of the serrated punched cut-outs 4 are, as is apparent from FIG. 8, stamped on one side in such a way that they have, on their stamped side, a slope with an angle β, and an overall asymmetrical trapezoidal basic shape is attained as a result.

The result is that the free passage A between two adjacent tips 5 steadily widens asymmetrically trapezoidally at an angle α in the direction of travel (arrow 3) along a plane y-y perpendicular to the longitudinal axis 9 of the cut-outs 4.

Figure 9:
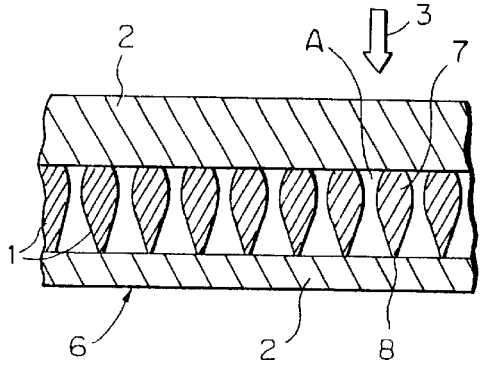
Figure 10:
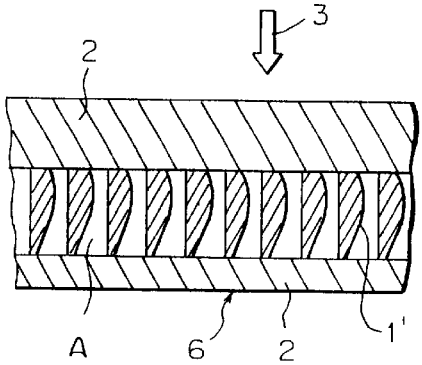

FIGS. 9 and 10 each show a partial section through a fixed comb 6 wherein the needles 1 are held between cover plates 2.

In the embodiment according to FIG. 9 the needles have, in cross section, a symmetrical wing profile, i.e., starting from a rounded leading face end 7 the needles are, in cross section, convexly curved outward and end in a relatively pointed rear face end 8. The result is a steady widening of the passage zone A of the needles in the region of the free needle projection and outside the cover plates 2 in the direction of the relative movement between the needles 1 and the sliver (arrow 3) with the exception of a short region at the beginning, whereby flow conditions are created during the movement like on an aircraft wing, thus resulting in an improved cleaning effect.

The embodiment according to FIG. 10 differs from the one in FIG. 9 only in that the cross section profile is asymmetrical, i.e., the needles have one largely flat or only slightly curved side flank and one side flank that is convexly curved outward.

In principle it would also be conceivable within the framework of the invention, to design only one side face outwardly convex and the other side face inwardly concave.

In the claims:

1. Card clothing for a textile machine used to comb fibers comprising a plurality of adjacent spaced-apart needles or serrated punched cutouts disposed in rows, wherein the needles or serrated punched cut-outs are stamped and accordingly have a non-rectangular cross-sectional geometry, wherein a free passage zone for the fibers being combed is formed between the spaced-apart needles or serrated punched cut-outs, and wherein the free passage zone (A) steadily widens viewed in a direction of travel of the fibers along a plane perpendicular to a longitudinal axis of the needles or the serrated punched cut-outs.

2. The card clothing according to claim 1, wherein the free passage zone (A) has a trapezoidal basic shape.

3. The card clothing according to claim 2, wherein the needles (1) or tips (5) of the serrated punched cut-outs (4) are stamped such that they have a triangular or trapezoidal basic shape in cross section.

4. The card clothing according to claim 3, wherein triangle corners or trapezoid corners of the triangular or trapezoidal cross section are formed rounded.

5. The card clothing especially according to claim 1, wherein the needles (1) have a cross-sectional area having a relatively bluntly rounded front end face (7), at least one side face that is convexely curved outward, and a relatively sharply tapered rear end face (8).

6. The card clothing according to claim 5, wherein the cross-sectional area is designed in the style of an aircraft wing profile.

7. The card clothing according to claim 6, and wherein the cross-sectional area has a symmetrical or asymmetrical wing profile.

8. The card clothing according to claim 5, and wherein one side face is curved outward and the other side face is concavely curved inward.

9. Card clothing for a textile machine used to comb fibers comprising a plurality of adjacent spaced-apart needles or serrated punched cut-outs disposed in rows, wherein the needles or serrated punched cut-outs are stamped and accordingly have a non-rectangular cross-sectional geometry, wherein a free passage zone for the fibers being combed is formed between the spaced-apart needles or serrated punched cut-outs, and wherein the free passage zone (A) steadily widens viewed in a direction of travel of the fibers along a plane perpendicular to a longitudinal axis of the needles or the serrated punched cut-outs; and wherein the needles (1) have a cross-sectional area having a relatively bluntly rounded front end face (7), at least one side face that is convexely curved outward, and a relatively sharply tapered rear end face (8).

10. The card clothing according to claim 9, wherein the cross-sectional area is designed in the style of an aircraft wing profile.

11. The card clothing according to claim 10, and wherein the cross-sectional area has a symmetrical or asymmetrical wing profile.

12. The card clothing according to claim 9, and wherein one side face is convexly curved outward and the other side face is concavely curved inward.

* * * * *